United States Patent [19]

Guitel

[11] Patent Number: 4,602,803

[45] Date of Patent: Jul. 29, 1986

[54] HEEL-RETAINING DEVICE FOR A SKI BINDING, OF THE TYPE WHICH IS MOUNTED ON A ROTARY PLATE

[75] Inventor: Jean-Claude Guitel, Nevers, France

[73] Assignee: Ste Look, Nevers, France

[21] Appl. No.: 701,200

[22] Filed: Feb. 13, 1985

[30] Foreign Application Priority Data

Feb. 29, 1984 [FR] France ..... 84 03110

[51] Int. Cl.[4] ..... A63C 7/10

[52] U.S. Cl. ..... 280/605; 280/636

[58] Field of Search ..... 280/605, 618, 620, 636

[56] References Cited

U.S. PATENT DOCUMENTS

| | | | |
|---|---|---|---|
| 4,165,887 | 8/1979 | Bunn, Jr. | 280/636 |
| 4,515,388 | 5/1985 | Emert et al. | 280/605 |

FOREIGN PATENT DOCUMENTS

| | | | |
|---|---|---|---|
| 2906726 | 10/1980 | Fed. Rep. of Germany . | |
| 1363895 | 1/1944 | France | 280/636 |
| 2278363 | 2/1976 | France | 280/605 |
| 2452300 | 10/1980 | France | 280/605 |
| 2453606 | 11/1980 | France | 280/605 |
| 2483792 | 11/1981 | France | 280/605 |
| 2500314 | 8/1982 | France | 280/605 |
| 2511258 | 2/1983 | France | 280/605 |
| 2513527 | 4/1983 | France | 280/605 |

*Primary Examiner*—John J. Love
*Assistant Examiner*—Eric Culbreth
*Attorney, Agent, or Firm*—Young & Thompson

[57] ABSTRACT

A heel-retaining device for a ski binding in which a ski brake is integrated with the device and in which the heel-holding member is carried by a rotary plate located beneath the heel of the ski boot. The rotary plate has a large opening within which are mounted the pedal for operating the pivotal arms of the ski brake together with the adjacent end portions of the braking arms. The pivot-pins of the braking arms are located below the level of the rotary plate. An upward displacement of the brake-operating pedal at the time of lifting of the ski-boot heel is not liable to interfere with the free rotational movement of the rotary plate and the components carried by the plate.

5 Claims, 5 Drawing Figures plate is forwardly inclined and the same applies to said rotary plate. The thickness of the support base increases towards the rear with a minimum thickness at the front end and a sufficient thickness at the rear end to ensure that the pivot-pins of the braking arms are located below the rotary plate.

In this form of construction, the axis of rotation of the rotary plate of the heel-retaining device is therefore inclined in the forward direction. This in fact constitutes an advantage, taking into account the slight natural inclination of the tibia of the skier's leg while skiing is in progress.

BRIEF DESCRIPTION OF THE DRAWINGS

Other features of the invention will be more apparent upon consideration of the following description and accompanying drawings, wherein.

DETAILED DESCRIPTION OF THE INVENTION

Figure 2:
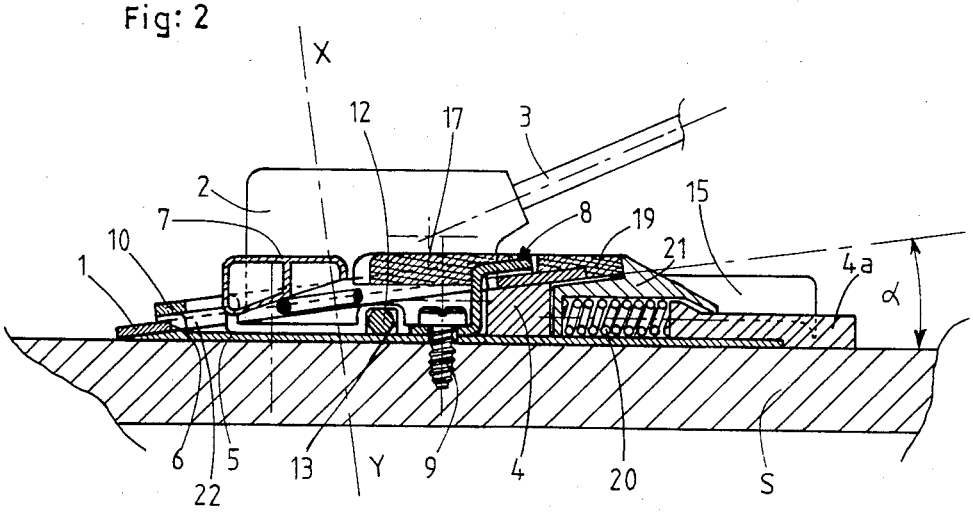
FIG. 2 is a vertical sectional view taken along the chain-dotted line II—II of FIG. 1.

The heel-retaining device illustrated in the accompanying drawings comprises a fixed support base above which is mounted a disk 1, said disk being intended to constitute a rotary plate beneath the location of the corresponding ski-boot heel. Said disk is provided with lateral flanges 2 forming heel-packing members on which are pivotally mounted the front end portions of the side arms of a stirrup member 3 placed around the rear end or heel contour of the ski boot. The rear cross-pin of said stirrup member is adapted to carry in known manner a pivotal member (not shown in the drawings) having the intended function of maintaining the heel of the ski boot in position. Said pivotal member can be of the type described in French Pat. No. FR-1,363,895. There is in any case no need to give a detailed description of this portion of the heel-retaining device since this latter does not constitute the object of the invention.

The fixed support base on which the disk 1 is rotatably mounted comprises a base plate 5 and a body 4 placed to the rear of said plate and above this latter. It is worthy of note in this connection that the top face of said support base is forwardly inclined at an angle $\alpha$ (as shown in FIG. 2) so that the thickness of the support base progressively increases from front to rear. In consequence, the rotary disk 1 is in turn placed at the same angle of slope, with the result that its axis of rotation X-Y is also inclined in the forward direction.

Said rotary disk 1 has a large opening 6 within which is mounted the operating pedal 7 of the ski-brake system, said system being integrated with the heel-retaining device in accordance with the invention, as will be described hereinafter in greater detail. Preferably, said opening has a circular contour and its center coincides with the axis of rotation X-Y of the rotary disk 1.

Said rotary disk is maintained in position on the fixed support base 4–5 by means of an annular retaining flange 10 formed by the rim of an annular member 8 of die-stamped sheet metal which is also placed within the opening 6 of said disk 1. At the rear end, said disk is adapted to carry a plate 17 which is intended to support the heel of the ski boot. The different parts constituting the support base are secured in rigidly fixed relation by any suitable means and the complete assembly is fixed on the ski S by means of screws 9.

The rotary disk 1 is adapted to carry at the rear a member 19 which is intended to serve as a support for the ski-boot heel. The assembly thus formed is guided in rotation by an annular member 22 which forms part of the support base and the external diameter of which corresponds to the diameter of the opening 6 of the disk 1. The annular member 22 is in turn guided in such a manner as to slide along the axis of the ski with respect to the fixed annular retaining member 8. Thus the disk 1 is capable not only of rotating about its own axis but also of sliding in the longitudinal direction.

However, a thrust member 21 subjected to the action of a thrust spring 20 tends to maintain the entire assembly in its normal position. The possibility of rearward movement of the rotary disk 1 of the pivot provides a number of different functions, namely:

the possibility of providing compensation for faulty adjustment of the assembly in the longitudinal direction;

the possibility of expansion or contraction of the ski boot;

removal of any danger of jamming of the ski boot during flexural deformation of the ski.

It can be observed that the assembly of fixed components is so designed and arranged as to leave in front of the opening of the rotary disk 1 a free space for the control portion of the ski brake which is integrated with the pivot under consideration.

The above-mentioned ski-brake system can be of the type described in French Pat. No. FR-2,483,792. This system accordingly comprises two pivotal braking arms 11 of wire, the pivot-pins of the braking arms being constituted by an elbowed portion 12 of said arms. These two portions extend approximately in the transverse direction with respect to the central longitudinal axis of the ski and are engaged within recesses 13 which are formed in the body of the support base and thus constitute swivel-bearings for the two pivotal arms 11.

It should be pointed out that these bearings are located opposite to the rear half of the opening 6 provided in the rotary disk 1 but below the level of said disk 1 (as shown in FIG. 2). These bearings are located at a short distance behind the axis of pivotal motion X-Y.

Figure 1:
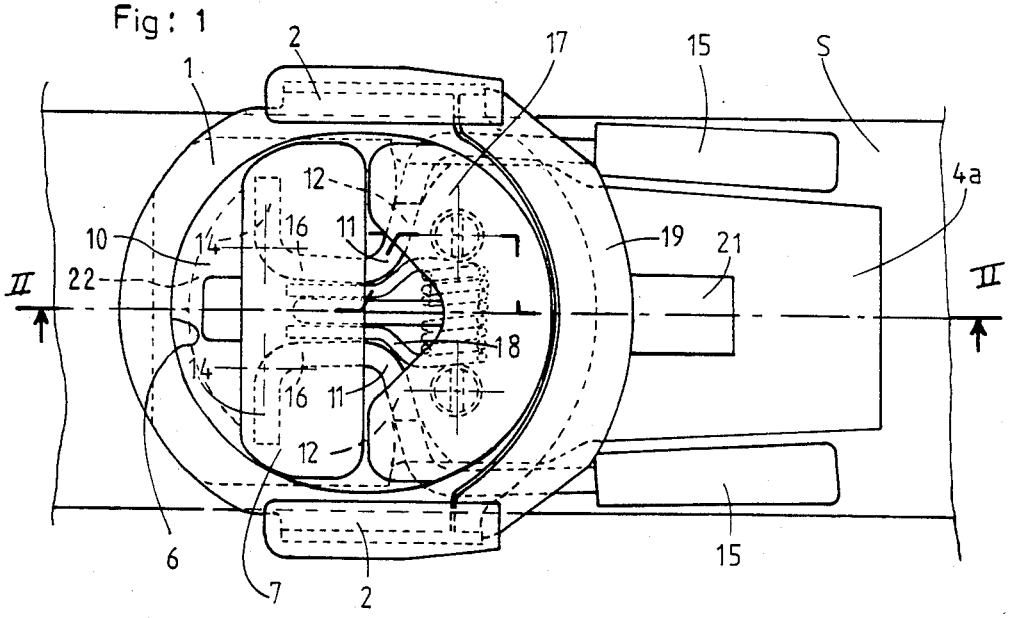
FIG. 1 is an overhead plan view of a ski-binding heel-retaining device in accordance with the invention.

In their position of readiness shown in FIGS. 1 and 2, the pivotal arms 11 are located approximately horizontally above the ski. The front ends of said arms have elbowed extensions 14 on which the operating pedal 7 is pivotally mounted. As described in French Pat. No. FR-2,483,792, said extensions 14 form a V in a transverse plane with respect to the ski and the arrangement is such that a downward displacement of the operating pedal 7 after lifting of the opposite active ends 15 of the braking arms causes inward withdrawal of said active ends above the ski as shown in FIGS. 1 and 2.

In this withdrawn position, the active ends 15 of the braking arms therefore extend towards the rear above the ski whereas the end portions 16 adjacent to the operating pedal 7 extend in front of the swivel-bearings 13. The operating pedal 7 is located in this position

HEEL-RETAINING DEVICE FOR A SKI BINDING, OF THE TYPE WHICH IS MOUNTED ON A ROTARY PLATE

BACKGROUND OF THE INVENTION

1. Field of the Invention

The present invention relates to heel-retaining devices for ski bindings, of the type in which the heel-holding member is carried by a rotary plate located beneath the heel of the ski boot.

2. Description of the Prior Art

In the so-called pivoted heel-retaining devices of the type mentioned above, the heel-holding member is usually mounted on a stirrup member which surrounds the heel of the ski boot and the side arms of which are pivotally mounted on flanges carried by each side of the rotary plate. The advantage of these heel-retaining devices lies in the fact that they permit pivotal displacement of the ski boot about a vertical axis located substantially opposite to the skier's tibia when a high torsional stress is developed and when a tripping action is produced on the safety toe-abutment member associated with the heel-retaining device in order to release the ski boot.

In order to provide an equal degree of safety in the event of a forward fall of the skier, the heel-holding member is so designed as to release the ski-boot heel automatically in the event that an unduly large external stress is exerted on the skier's leg. It is readily apparent that, when combined extension and torsion forces arise, the two retaining devices of the ski binding (namely the toe-abutment device and heel-holding member) are both urged towards their boot-releasing position whilst the rotary plate of the heel-retaining device is caused to undergo a pivotal displacement under the action of the torsional stress exerted on the skier's foot.

By reason of the advantages attached to this design concept, it has already been proposed to associate a heel-retaining device of the aforementioned type with the ski-brake device usually provided for stopping a ski as soon as a ski boot has been completely released from the ski. In some designs already proposed, the ski brake is simply associated with the corresponding heel-retaining device whereas in other designs, the ski brake is completely integrated with said device.

Thus FIGS. 6 to 9 of French Pat. No. FR-2,278,363 illustrate the association of a pivoted heel-retaining device and a ski-brake device which is mounted behind the rotary plate of said heel-retaining device in order to be controlled by the boot-engagement support of said device. In this form of construction, there is therefore no integration of the ski brake in the pivot of the heel-retaining device, thus resulting in an increase in overall size of the assembly. Furthermore, the control of the ski brake by means of the boot-engagement support of the heel-retaining device is subject to many disadvantages such as the attendant danger of ski-brake release while skiing is in progress, and unreliability of brake control by reason of the elasticity of the heel-retaining device. In addition, certain components of the ski-brake device are liable to interfere with rotational movement of the rotary plate of the heel-retaining device under certain circumstances. It is in fact extremely doubtful whether the assembly in accordance with this design is really capable of operating.

French Pat. No. FR-2,453,606 describes two different forms of construction of a pivot-type heel-retaining device associated with a ski brake. In one embodiment (shown in FIGS. 18 to 21), the brake is stationarily fixed and placed behind the pivot, the brake-operating pedal being placed above the rotary plate of the pivot in the position of readiness. Under these conditions, at the time of boot disengagement under simple torsional stress, one of the lateral flanges of the rotary plate moves very rapidly into a position of abutting contact with the brake-operating pedal. This has the effect of abruptly stopping the rotation of the pivot with all the disadvantages which this is liable to entail.

In the other form of construction described in the cited patent (with reference to FIGS. 1 to 17), the ski brake is mounted on the rotary plate of the pivot. But after a boot disengagement under torsional stress which has caused a rotational displacement of the pivot-plate, operation of the ski brake is wholly unpredictable. Moreover, in the event of a complex fall which has initially resulted in lifting of the ski-boot heel, the upward displacement of the brake pedal permits free rotation of the pivot. The system in accordance with this design is also delicate since the ski brake is carried by the pivot-plate and rotates with this latter. Should one of the braking arms be deformed, however, rotation of the pivot would be hindered or even prevented.

The German patent specification No. DE-A 2,906,726 also describes a pivoted heel-retaining device in which a fixed ski-brake is incorporated in the rotary plate. However, rotational displacement of the pivot is possible only over a very limited range of angular travel when the ski brake is in the standby position. This accordingly prevents the pivot from performing its normal function.

The same remark applies to the forms of construction described in the French patent specification Nos. FR-A 2,500,314 and FR-A 2,511,258.

SUMMARY OF THE INVENTION

For the reasons given in the foregoing, the object of the present invention is to provide a heel-retaining device of the type under consideration, that is to say a pivoted heel-retaining device in which a ski brake is integrated but the conceptual design of which is such that the constituent elements of the ski brake are not liable to limit or interfere with the rotational displacement of the rotary plate under any circumstances.

To this end, the distinctive feature of said heel-retaining device lies in the fact that its rotary plate has a large opening within which are disposed the operating pedal for controlling the pivotal arms of the ski brake together with the adjacent end portions of said arms whilst the pivot-pins of the braking arms are located below the level of the rotary plate.

Thus, even if the operating pedal of the ski brake is caused to undergo an upward displacement together with the adjacent end portions of the braking arms, this is not liable to prevent or interfere with the rotational displacement of the rotary plate and of the elements carried by this latter.

Preferably, the opening formed in the rotary plate has a circular contour and its axis coincides with the axis of rotation of said plate, the operating pedal of the ski brake and the adjacent end portions of the pivotal braking arms being contained within the space delimited by the contour of the opening of the rotary plate.

In an advantageous form of construction, the top face of the fixed base which serves as a support for the rotary within the front half of the large opening 6 formed in the rotary disk 1. Preferably, a fixed bearing plate 17 is placed within the rear portion of said opening 6 in order to serve as a support for the corresponding portion of the ski-boot heel.

The external contour of said bearing plate corresponds to a circular arc and the operating pedal 7 is in turn provided at its periphery with rounded portions in order to ensure that the rotary disk can rotate freely around these two members.

A restoring spring 18 tends continuously to cause upward displacement of the operating pedal 7 and of the adjacent end portions of the braking arms 11. However, as long as the heel of the ski boot is placed on the rotary disk 1, said pedal is maintained in the lowered position shown in FIGS. 1 and 2 in which the top face of said pedal is located at the same level as the top face of the bearing plate 17. Under these conditions, the active braking ends 15 of the pivotal arms are also maintained in the raised position above the ski in their inwardly withdrawn position with respect to the edge faces of the ski.

However, as soon as the heel of the ski boot is caused to lift, the spring 18 initiates upward displacement of the operating pedal 7. This accordingly produces a pivotal displacement of the braking arms 11 in the direction of the arrow F about their pivot-pins 12, this movement being accompanied by a relative outward displacement of the active braking ends 15 on each side of the edge faces of the ski.

In point of fact, when a movement takes place as described above, this is in no way liable to hinder the free rotational movement of the rotary disk 1 and of the different elements carried by this latter. This is due to the fact that the operating pedal 7 together with the adjacent end portions 16 of the braking arms are placed within the space delimited by the opening 6 of said rotary disk and that, in addition, the pivot-pins 12 of the braking arms are located below the level of the rotary disk 1.

Figure 4:
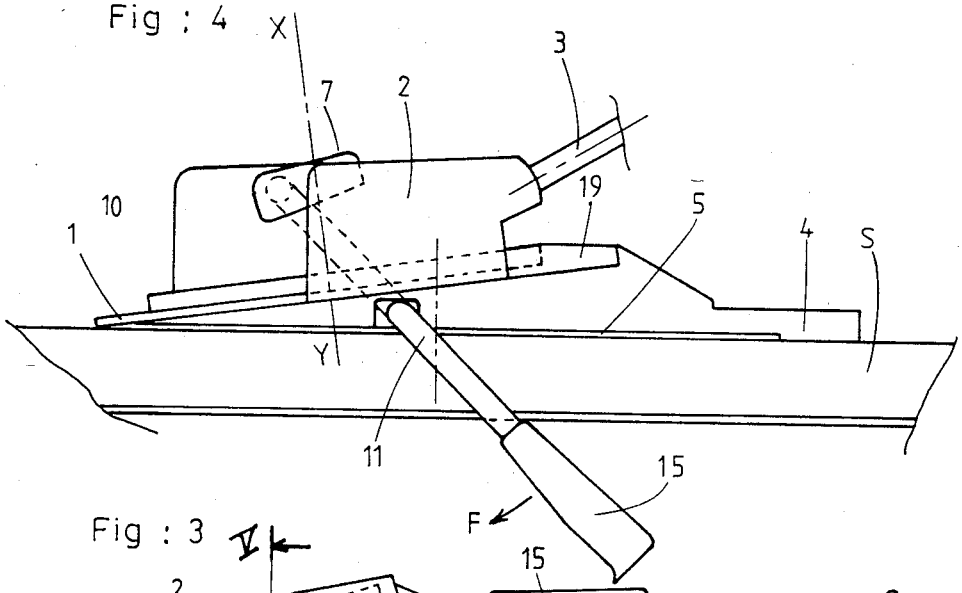
FIG. 4 is a corresponding view in side elevation.
Figure 3:
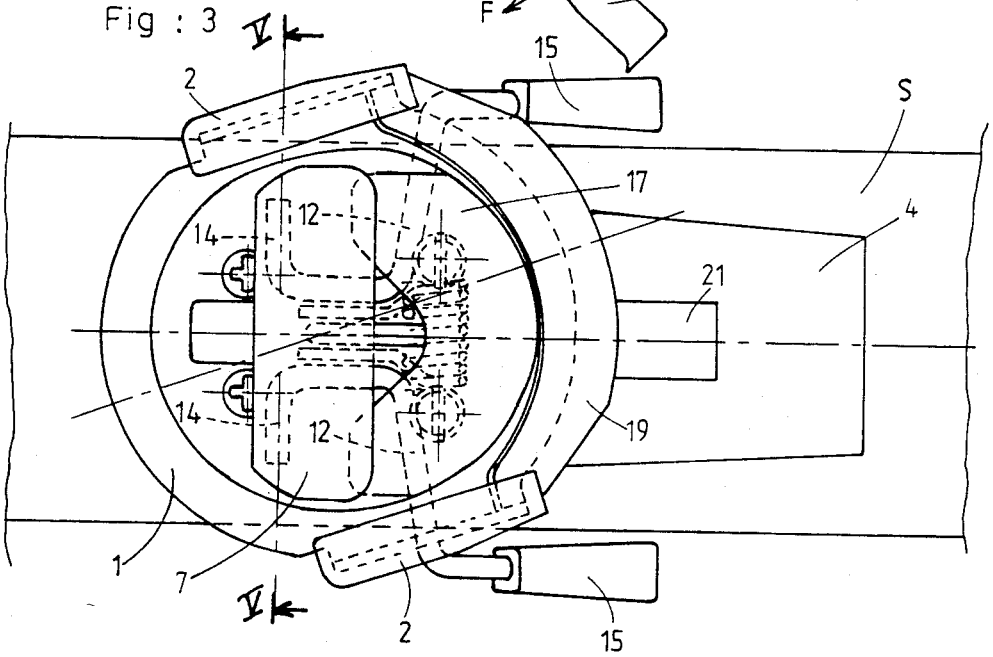
FIG. 3 is a view which is similar to FIG. 1 but shows the same heel-retaining device after rotational displacement of the rotary plate of said device and initial pivotal displacement of the ski-brake arms towards their braking position.
Figure 5:
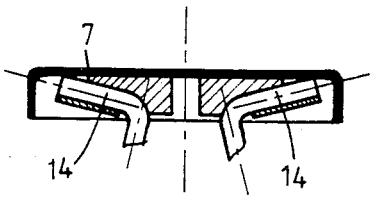
FIG. 5 is a fragmentary sectional view taken along line V—V of FIG. 3.

Under these conditions, the presence of the ski-brake system which is integrated in the heel-retaining device in accordance with the invention is in no way liable to disturb the normal operation of this latter, as can be observed in FIGS. 3 and 4 which illustrate the pivot during rotation while the movements of opening-out and downward displacement of the ski-brake system are taking place. It is in fact a point worthy of note that rotation of the pivot is not hindered by any component of the ski-brake system and that, in particular, the lateral flanges 2 of the pivot are not liable to abut against the brake-operating pedal 7 or against the adjacent end portions of the braking arms.

In order to prevent excessive upward displacement of the ski-boot heel with respect to the ski, the thickness of the support base is of minimum value at the front end and its thickness at the rear end is just sufficient to ensure that the pivot-pins 12 of the braking arms are located below the level of the rotary disk 1. Under these conditions, the angle of slope $\alpha$ of the rotary disk is of the order of 8°. This value is advantageous since the axis X-Y of rotation of the disk 1 is thus slightly inclined in the forward direction and is similar to the natural angle of slope of the tibia of the skier's leg when skiing is in progress.

However, the top face of the support base of the heel-retaining device under consideration need not necessarily be inclined in the forward direction but could equally well be parallel to the top face of the ski, the thickness of the support base being just sufficient to ensure that the pivot-pins 12 of the braking arms are located below the level of the rotary disk 1.

Moreover, the ski brake which is integrated with the heel-retaining device in accordance with the invention can be of a type which is different from the system described in the foregoing on condition that it comprises an operating pedal which can be placed within the large opening 6 of the rotary disk 1 and that the pivot-pins of its braking arms are located below the level of said disk. It is thus possible to contemplate the use of a ski brake of the type described in French Pat. Nos. FR-A 2,452,300 and FR-A 2,513,527.

What is claimed is:

1. In a heel-retaining device for a ski binding, comprising a heel holding member carried by a rotary plate in such a position as to be located beneath the heel of a ski boot, a ski brake having arms carried by the device, said rotary plate having a large opening in which is disposed an operating pedal for pivotally swinging said arms of the ski brake, said opening having a circular contour having an axis that coincides with the axis of rotation of said plate; the improvement comprising means pivotally mounting said brake arms within the space delimited by the contour of the opening of the rotary plate.

2. A device as claimed in claim 1, further including a fixed base which serves as a support for said rotary plate, said fixed base having a top surface which is forwardly inclined, said rotary plate being similarly forwardly inclined and having an axis of rotation which is forwardly inclined, the thickness of said support base being progressively greater toward the rear, said pivot mounting means for said braking arms being disposed beneath the plane of said rotary plate.

3. A device as claimed in claim 1, said operating pedal being pivotally mounted on elbowed extensions of adjacent end portions of the braking arms, said pivotal mounting means for said braking arms including intermediate elbowed portions of said arms disposed rearwardly of said operating pedal.

4. A device as claimed in claim 1, said pedal occupying substantially the front half of said opening formed in the rotary plate whilst said pivotal mounting means are disposed within a rear portion of the space delimited by the contour of the opening of said rotary plate.

5. A device as claimed in claim 1, and further including a fixed bearing plate disposed within the opening of said rotary plate to the rear of said pedal and adapted to serve as a support for the heel of a ski boot.

* * * * *